United States Patent [19]

Mörz

[11] 4,365,253

[45] Dec. 21, 1982

[54] ANTENNA FEEDER SYSTEM FOR A TRACKING ANTENNA

[75] Inventor: Günter Mörz, Ludwigsburg, Fed. Rep. of Germany

[73] Assignee: Licentia Patent-Verwaltungs-GmbH, Frankfurt am Main, Fed. Rep. of Germany

[21] Appl. No.: 268,377

[22] Filed: May 29, 1981

[30] Foreign Application Priority Data

May 30, 1980 [DE] Fed. Rep. of Germany ..... 3020514

[51] Int. Cl.[3] ..... H01Q 13/00

[52] U.S. Cl. ..... 343/786; 343/772

[58] Field of Search ..... 343/786, 729, 755, 776, 343/781, 854, 772

[56] References Cited

U.S. PATENT DOCUMENTS

| | | | |
|---|---|---|---|
| 4,030,048 | 6/1977 | Foldes | 343/786 |
| 4,048,592 | 9/1977 | Drabowitch | 333/6 |
| 4,077,039 | 2/1978 | Ren et al. | 343/786 |
| 4,258,366 | 3/1981 | Frosch et al. | 343/786 |

*Primary Examiner*—David K. Moore

*Attorney, Agent, or Firm*—Spencer & Kaye

[57] ABSTRACT

In a feeder system associated with an antenna for transmitting circularly polarized signals and for receiving a circularly polarized beacon signal, which system includes an exciter having an aperture whose cross section is symmetrical to at least one major axis of the aperture, the exciter being arranged to excite higher modes of the beacon signal as a function of deviations of the axis of the beacon signal from the major axes of the antenna radiation pattern, and a device for coupling the higher modes to produce deviation signals providing information for positioning the antenna in order to eliminate such deviations, the system further includes a polarization converter containing amplitude and phase compensating components and connected between the exciter and the coupling device for conducting electromagnetic signals therebetween, and the coupling device includes a polarization filter connected to the converter for separating signals into components having mutually orthogonal polarization directions, the filter being provided with a respective communications signal input-/output port and a respective deviation signal output port for signal components having each polarization direction.

9 Claims, 10 Drawing Figures

ANTENNA FEEDER SYSTEM FOR A TRACKING ANTENNA

BACKGROUND OF THE INVENTION

The present invention relates to an antenna feeder system for circularly polarized signals, the system including an exciter whose aperture cross section is symmetrical with respect to at least one major axis and a device for coupling a plurality of wave modes, such as higher order modes as divergence-indicating signals for positioning the antenna in that excitation is effected proportionally to the divergence of the major axis of the antenna from the direction of a received circularly polarized beacon signal.

One property sought for communications satellites is that they cover a precisely defined area on the earth and affect adjacent areas as little as possible, particularly where the supply of television programs to only one of two adjacent countries is concerned.

In order to prevent a radiation field emitted by a satellite antenna from drifting to adjacent areas, the alignment of the transmitting antenna must be stabilized. The paper by applicant entitled "Analyse und Synthese von elektromagnetischen Wellenfeldern in Reflektorantennen mit Hilfe von Mehrtyp-Wellenleitern" [Analysis and Synthesis of Electromagnetic Wave Fields in Reflector Antennas with the Aid of Multiple Mode Waveguides] Dissertation D82, RWTH-Aachen (1978), pages 46 et seq., discloses, for example, such a transmitting antenna which operates as a monopulse sensor.

This transmitting antenna simultaneously serves as a receiving antenna for a beacon signal which is transmitted by a beacon station disposed in the center of the prescribed broadcast area. In dependence on the deviation of the major axis, i.e., the axis of the radiation pattern, of the exciter of the satellite transmitting antenna from the received beacon signal, higher order wave modes are excited in the transmitting antenna. These modes are coupled in by means of a mode coupler disposed directly behind the exciter and are used as deviation signals. The beacon signal employed here is a linearly polarized signal.

However, the antenna feeder system to be discussed below is a system including a device for coupling in higher wave modes as deviation signals for circularly polarized signals wherein the exciter may also have a shape which is symmetrical only with one major axis of the aperture surface so as to produce, for example, an elliptical illumination area at the earth's surface. A further prerequisite to be considered in the present system is that the frequency of the received signal which is composed of the beacon signal and possibly an additionally transmitted communications signal, is much greater than the frequency of the transmitted signal ($f_{rec}=17.3$ to 18.1 GHz, $f_{tr}=11.7$ to 12.5 GHz). Because of the requirement that $f_{rec}>>f_{tr}$, it is possible to couple the higher order modes into the exciter only with difficulty since the exciter throat cannot be made small enough to force the higher modes to be totally reflected, which is a prerequisite for selectively coupling in the higher order modes. Otherwise, a very complicated and cumbersome coupling device is required. Such a coupling device is disclosed, for example in German Auslegeschrift No. 2,608,092 and corresponding U.S. Pat. No. 4,048,592.

SUMMARY OF THE INVENTION

It is an object of the present invention to provide an antenna feeder system for circularly polarized signals, which system includes an exciter whose aperture cross section is symmetrical to at least one major aperture axis and a device which generates two mutually independent deviation signals for position stabilization according to the multimode monopulse principle. Another object of the invention is to produce a very great polarization purity of the transmitted communication signals and to interfere as little as possible with the required minimum attenuation of the communication signals.

The above and other objects are accomplished according to the invention in that a polarization converter containing amplitude and phase equalization, or matching, devices is disposed between the exciter and the device for coupling in higher order modes, the higher order modes are coupled in through a polarization filter which is connected to the polarization converter and serves to separate two orthogonally polarized signals. The polarization filter has, associated with one polarization direction, a communication signal input or output and an output for a first deviation signal and it has associated with the other polarization direction a further communication signal input or output and an output for a second deviation signal. A correction network is connected to the outputs for the deviation signals from the polarization filter, and if the deviation signals for the two orthogonal deviation directions x and y are present at the outputs in coupled form, this correction network decouples the coupled deviation signals.

Due to the fact that, according to the invention, the coupling structure for coupling in the higher modes is not disposed in the exciter but behind it, there is no interference with the excitation of the advantageously utilized hybrid modes of grooved exciters, disclosed in German Pat. No. 2,616,125. They are used with preference because they are best able to meet the high demands with respect to efficiency of illumination (aperture efficiency) and freedom from cross polarization as well as matching the lobe shapes in the E and H components of the radiation diagrams.

A further advantage of this antenna feeder system is the arrangement of the polarization converter between the exciter and the coupling structure. Firstly, in this position, it does not interfere with the excitation of the hybrid modes and, secondly, this provides an opportunity to provide it with means for compensating the interfering influences of the exciter on the two deviation signals and on the purity of polarization of the transmitted communication signals.

DESCRIPTION OF THE PREFERRED EMBODIMENTS

Figure 1A:
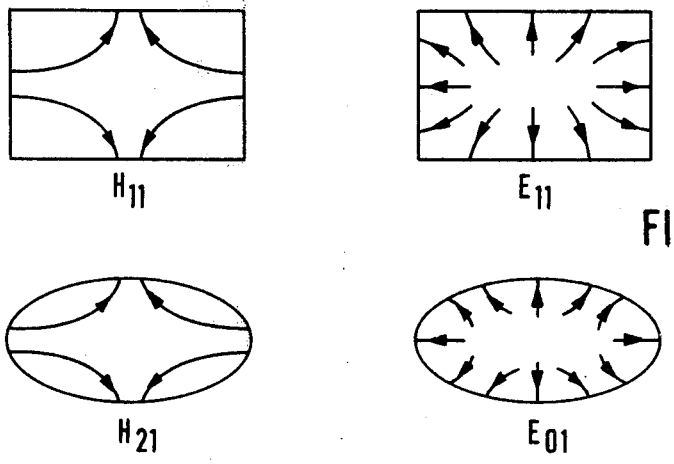
FIGS. 1*a, b, c* are wave mode diagrams illustrating the formation of independent deviation signals with rectangular and elliptical exciter apertures.

First, the generation of independent deviation signals in the antenna feeder system will be explained for an exciter having a rectangular aperture and for an exciter having an elliptical aperture. FIG. 1*a* shows the types of electric field patterns that are excited in exciter horns having rectangular and elliptical cross sections and smooth walls. With the rectangular cross section, there appear the two modes $H_{11}$ and $E_{11}$ and with the elliptical cross section, the $H_{21}$ and $E_{01}$ modes (the notations being borrowed from the mode identifications in circular waveguides). Depending on the deviation of a circularly polarized beacon signal B from the major axes of the antenna illuminated by the feeder system, the $H_{11}$ and $E_{11}$ modes or the $H_{21}$ and $E_{01}$ modes are superposed in a certain manner.

Figure 1B:
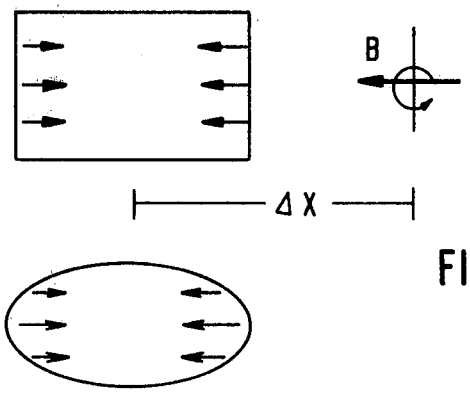
Figure 1C:
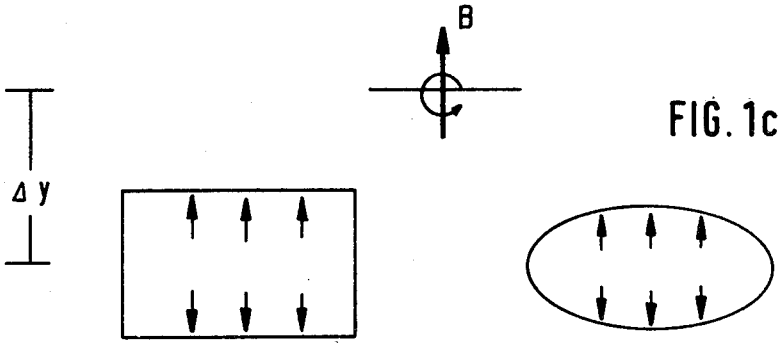

With a nonrectangular (e.g. elliptical) cross section of the feedhorn throat, the required transition from the throat cross section to the cross section of the polarization filter converts the higher modes containing the deviation information to the corresponding modes of the input waveguide of the polarization filter (e.g. to the $H_{11}$ and $E_{11}$ modes). In the ideal case, as shown in FIG. 1*b*, for a deviation $\Delta x$ of the beacon signal B, the two modes are superposed on one another in phase opposition in the polarization filter equipped with a mode coupler, resulting in an electric field in the x direction. With a deviation $\Delta y$ of the beacon signal, the two modes are superposed in the same phase resulting in an electric field in the y direction as shown in FIG. 1*c*. Only then, i.e. if both higher order modes are superposed in the correct phase in the manner described above, will the coupled-in signals be mutually independent in their deviation information.

If, for example, the rectangular feedhorn has a grooved structure, two modes which are superposed to yield independent deviation signals will no longer be excited, but rather, with an x deviation, there results the hybrid $HE_{21}$ mode and with a y deviation, the hybrid $HE_{12}$ mode, each with unequivocal deviation information. But this case will not be discussed in detail here because it does not require any significant changes in the feeder system. In the required transition from the grooved exciter to a waveguide with smooth walls, every hybrid mode will again decompose into the above-described $H_{11}$ and $E_{11}$ modes.

Figure 2:
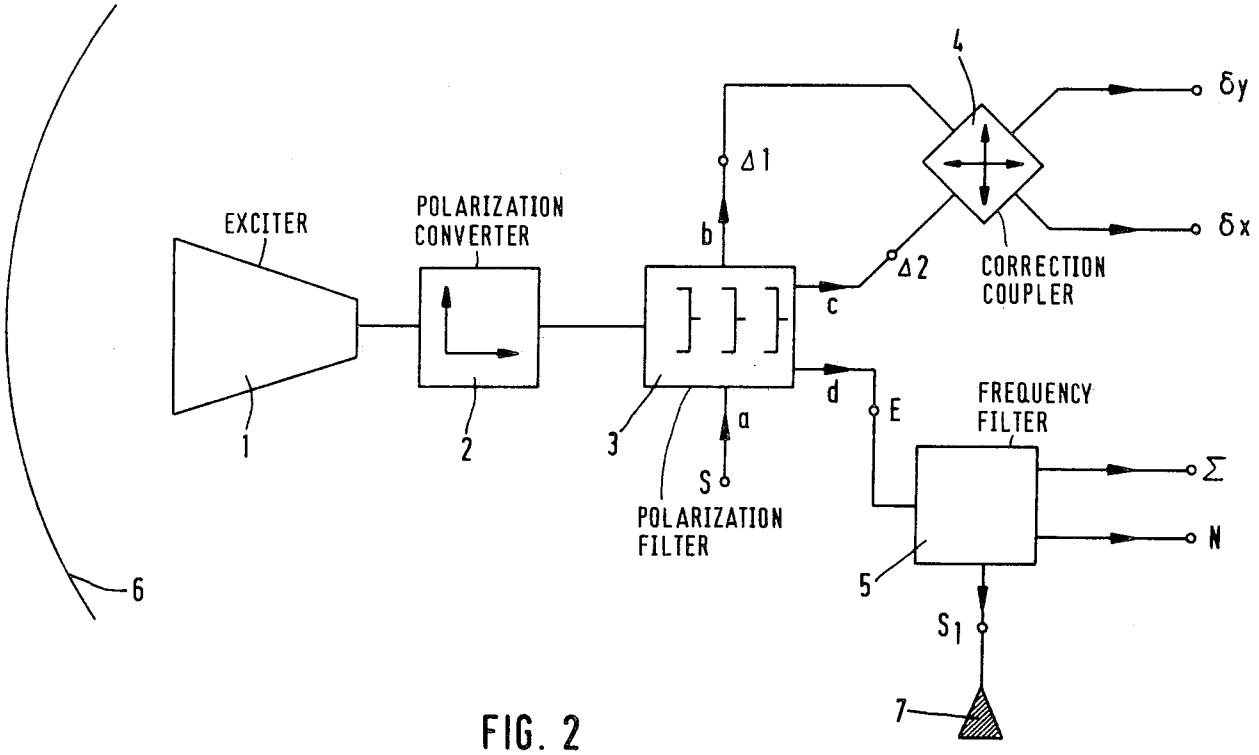
FIG. 2 is a block circuit diagram of a preferred embodiment of an antenna feeder system according to the invention.

FIG. 2 shows a block circuit diagram of an antenna feeder system for circularly polarized signals, the system including an exciter 1 which is symmetrical for example with two orthogonal major axis of the aperture surface, which surface is rectangular in this embodiment.

Through the intermediary of a transition piece for matching cross sections, a polarization converter 2 is disposed behind the exciter and this polarization converter 2 is followed by a polarization filter 3 with mode coupler.

A signal S to be transmitted is fed to the input a of the polarization filter 3. At the outputs b and c, there then appear deviation signals $\Delta 1$ and $\Delta 2$ which generally contain not unequivocal but mixed deviation information. The mixing of the deviation information is due to differences in the transmission properties of the higher order modes in the waveguides, with the result that the phase-correct superposition of the modes and thus the independence of the deviation signals is lost. An interfering influence which contributes to coupling of the deviation signals is provided by the difference in propagation constants of the feedhorn for the two higher modes. Generally the deviation signals $\Delta 1$ and $\Delta 2$ are associated to a mixture of the electric field patterns shown in FIG. 1*b* and in FIG. 1*c*. This means that a deviation signal appears at port b or c even if there is only one deviation $\Delta x$ or $\Delta y$ respectively. The deviation signals $\Delta 1$ and $\Delta 2$ are sensitive to linear polarization as well as to the linearly polarized components of circular polarization.

An interference effect on the circularly polarized communication signals to be transmitted is created by the different phase shifts of the exciter feedhorn in its two major planes. The incoming circularly polarized signal is elliptically distorted by the different phase shifts. A further interfering influence possibly results from differences in antenna gain in the two major planes of the horn. Here again, circular polarization is worsened into an elliptical polarization. Differences in gain and phase can also be produced by the material of the antenna reflector 6.

The polarization converter 2 disposed behind the exciter 1 in which these interferences occur, includes means for compensating the above-described amplitude and phase errors. A practical embodiment of such a special polarization converter will be described below.

The polarization converter 2 and the subsequent polarization filter 3 also cause coupling of the deviation signals due to different influences on the $H_{11}$ and $E_{11}$ modes. But independently of the individual coupling causes, the signals $\Delta 1$ and $\Delta 2$ are decoupled again at the outputs b and c of the polarization filter with mode coupler by means of a subsequently connected correction coupler 4, e.g. in the form of a conventionally employed directional coupler. At the outputs of the correction coupler 4 there then appear unmixed deviation signals $\delta x$ and $\delta y$. These signals are sensitive to linearly polarized beacon signals as well as to the linearly polarized components of a circularly polarized beacon signal. This means that the signal $\delta x$ ($\delta y$) is sensitive to the x (y)-component of the beacon signal.

The correction coupler can be omitted if the exciter meets certain phase conditions for the higher modes. For example, in an elliptical exciter, the desired superposition of the higher modes $H_{21}$ and $E_{01}$ which then provides the decoupled deviation signals $\delta x$ and $\delta y$ directly at the outputs of the polarization filter can be attained by proper selection of the length of the feedhorn. It is thus possible, by a directed predetermination of the length of the feedhorn, to create a field configuration which effects compensation of the interfering influences of the exciter, polarization converter and polarization filter. The length of the horn must be selected in such a way that the individual fields $H_{21}$ and $E_{01}$ to be superposed effect, for the corresponding modes, a mutual phase position of 0° or a multiple of 180° at the mode couplings. This phase relation can be set also by predetermining the length of the feedhorn throat, or exciting section, which need not necessarily have the same cross-sectional configuration as the exciter aperture. For example, the horn throat of an exciter having a horn section with elliptical aperture advantageously has a circular cross section, as disclosed in my German Patent Application No. P 2,939,562.8 and counterpart U.S. application Ser. No. 191,745, filed on Sept. 29, 1980. In this case, the cross section of the horn throat must then be adapted to the cross section of the polarization converter by means of a transition waveguide section.

At the output d of the polarization filter 3 there appears the received signal E which is separated, in a subsequently connected frequency filter 5, into a reference signal Σ derived from the beacon signal and a possibly additionally transmitted communication signal N. A comparison between the reference signal Σ and the deviation signals δx and δy derived from the beacon signal permits derivation of a control parameter for the antenna follow-up, or tracking.

In addition to the reference signal Σ and the communication signal N at the port d of the polarization filter 3 there appears an interference signal $S_1$ which is composed of undesirable components of the transmitted signal S, which components are reflected at the exciter 1 or at the antenna reflector 6. This reflected interference signal $S_1$ which, without special compensation measures, would worsen the purity of polarization of the radiation field, is separated from the received signal E by the frequency filter 5 and absorbed in an absorber 7.

Figure 3A:
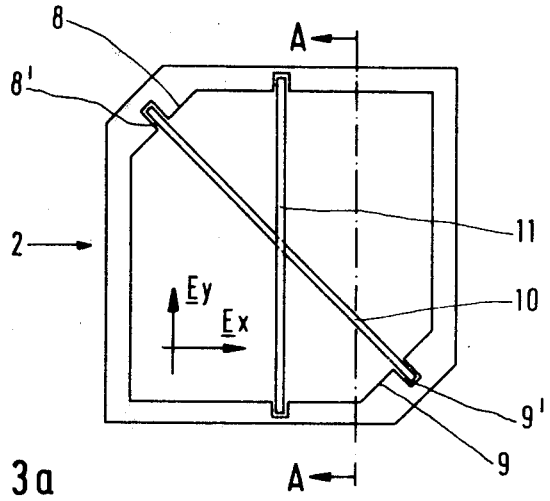
FIGS. 3*a* and *b* are, respectively, an end view and a side cross-sectional view of an embodiment of a polarization converter used in the feeder system of FIG. 2.
Figure 3B:
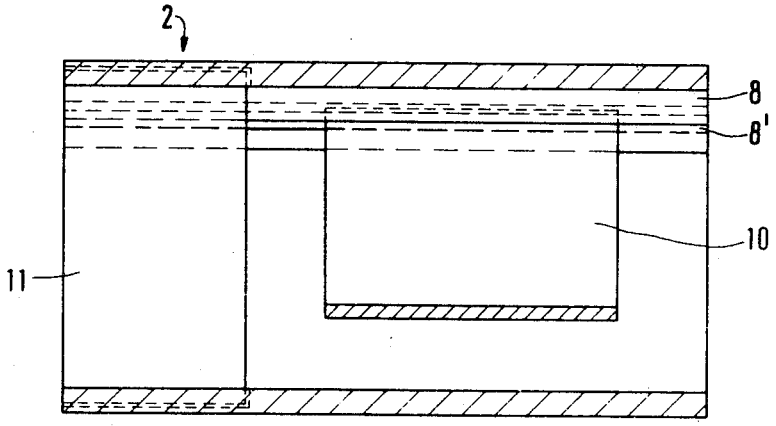

FIGS. 3*a*, and 3*b* show a preferred practical embodiment of a polarization converter 2 in the form of a basically square waveguide section provided with means for converting circular into linear polarization and for the purpose of equalizing, or matching, amplitude and phase. FIG. 3*a* is a front view and FIG. 3*b* a longitudinal cross-sectional view of the polarization converter, taken along line A—A of FIG. 3*a*. In the case of exciters having identical propagation and radiation characteristics for the major orthogonal modes, as is the case with exciters having identical symmetry with two major axes of the aperture surface, e.g. circular or square exciters, the coupling means, in combination, are set in the polarization converter so that a fed-in, linearly polarized wave is split broadbandedly, at the output of the polarization converter, into two orthogonal waves Ex and Ey having identical amplitudes and a 90° difference in phase (3.01 db coupling). Usually a power splitter having equal signal amplitudes at its outputs is called a "3 db-coupler". In practice this is not correct. The correct coupling is 3.0103 db≈3.01 db. These waves then form the components of a circularly polarized wave.

Excitation with unequal propagation and radiation properties for the major orthogonal modes, i.e. those which are symmetrical only to one major axis of the aperture surface, e.g. rectangular or grooved, paths will produce identical propagation and radiation characteristics in the two major planes only if the radiation diagram of the first major mode in the E plane is identical with that of the second major mode in the H plane and vice versa (E-H matching). In practice this requirement is generally not met to a sufficient extent so that differences in gain, particularly in the main direction of radiation, result in a difference in amplitude (Ex≠Ey) which can be equated with a degradation of the circular field into an elliptical field.

In the present embodiment, the means for converting circular into linear polarization and compensating amplitude include two chamfered internal surfaces 8 and 9 provided with grooves 8' and 9' and located in two diagonally opposite corners of the square polarization converter, and a diagonally oriented dielectric plate 10 which engages in the grooves 8' and 9'. Surfaces 8 and 9 and plate 10 form angles of 45° with the converter sides. The surfaces 8 and 9 have an inductive effect and the diagonally oriented dielectric plate 10 has a capacitive effect. These two capacitively and inductively acting coupling means together exhibit an almost frequency independent coupling behavior.

In practice, it may happen that differences in gain as a result of the antenna characteristics are frequency dependent so that the amplitude equalization must also be made frequency dependent. This can be done with the aid of a predominantly capacitive coupling for a coupling which increases as the frequency rises, and with a predominantly inductive coupling for a coupling which decreases with rising frequency. For a lesser inductive coupling, the dielectric plate 10 employed is made thicker or longer in the longitudinal direction in conjunction with a reduction in the width of surfaces 8 and 9, whereas for increased inductive coupling a shorter or thinner plate 10 is used in conjunction with wider surfaces 8 and 9. With a very large frequency dependence, one of the two coupling means 8 and 9, or 10 can also be omitted or the dielectric plate 10 can be disposed along the diagonal opposite from that of the surfaces 8 and 9. In order to reduce self-reflection of the inductive and capacitive coupling means, the surfaces 8, 9 and the plate 10 may be designed with steps in their length dimension, i.e., as λ/4 transformers.

Amplitude matching is effected in that the above-described coupling means 8, 9 and 10 which lie in diagonal planes are dimensioned in such a manner that unequal splitting of a fed-in wave into the two major planes of the square polarization converter is realized. In this way, the output wave is not circularly but elliptically polarized with the major axes of the polarization ellipse lying parallel to the center axes of the square output cross section of the polarization converter. Although the wave components Ex and Ey of the elliptically polarized wave are shifted in phase by 90° with respect to one another, they are no longer equal in magnitude. The magnitudes of the wave components Ex and Ey can thus be set in such a way that a difference between Ex and Ey produced, for example, by different antenna gains in the x and y planes, can be compensated; i.e. the elliptically polarized output wave of the polarization converter again produces a circularly polarized field in the major direction of radiation in the radiation field of the exciter.

In addition to amplitude matching, phase compensation is also provided in the polarization converter in that it compensates phase shifts between Ex and Ey caused by, for example, a rectangular or elliptical exciter.

Such phase compensation can be effected by a further dielectric plate 11 which is disposed either horizontally or vertically upstream of the diagonally oriented plate 10, depending on whether the phase of Ex is supposed to be varied with respect to Ey or Ey with respect to Ex.

Alternatively, the phase correction can be effected, for example, by means of a rectangular waveguide section placed at the input end of the square polarization converter near the exciter. Such a rectangular waveguide section then has one side length reduced with respect to the side length of the polarization converter (not shown in the drawing). Both means—the dielectric plate and the rectangular waveguide section—can be used together to compensate the frequency dependence of the phase error. Depending on the magnitude and direction of the frequency response, the one or the other compensation means should be predominant.

The polarization filter 3 with mode coupling employed in a system according to the invention can be the filter disclosed in German Offenlegungsschrift [Laid-open Application] No. 2,651,935, modified for the present invention.

Figure 4:
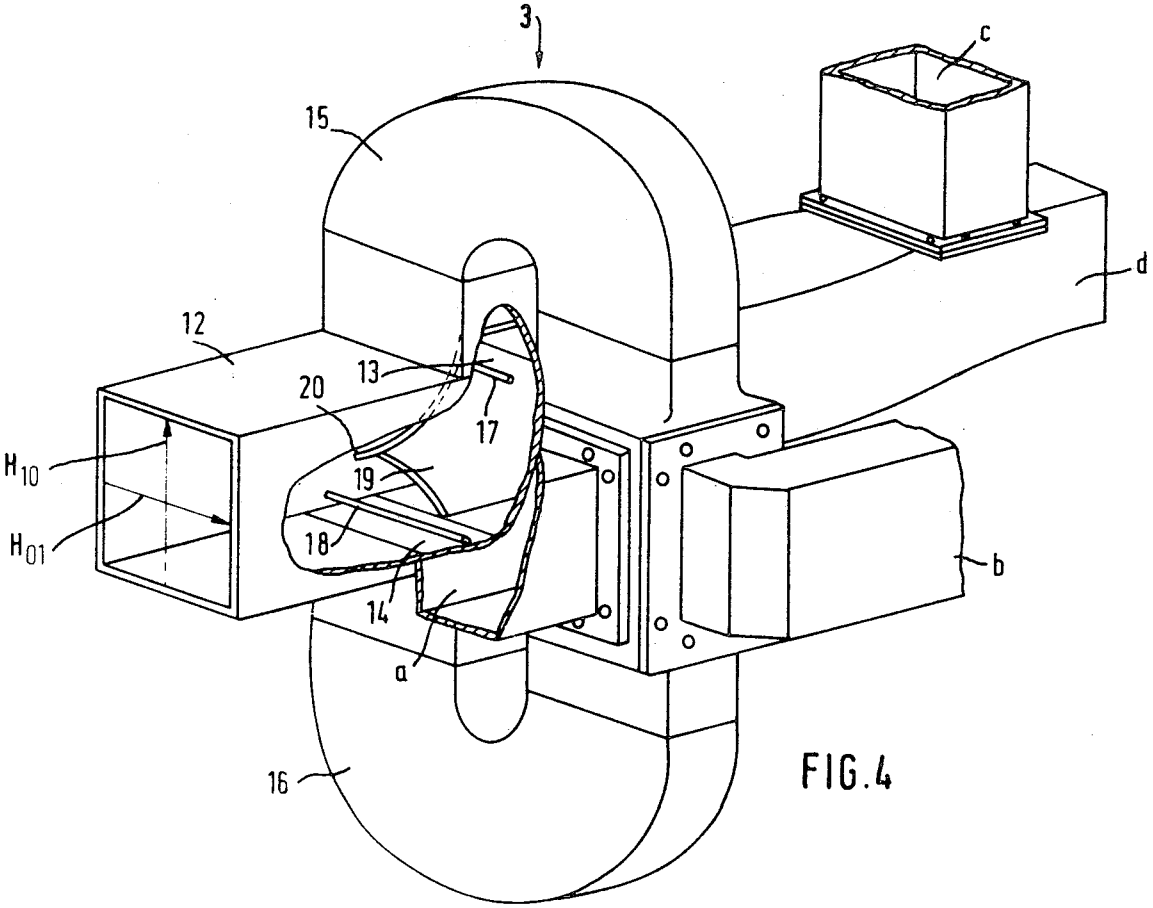
FIG. 4 is a partly cut-away perspective view of an embodiment of a polarization filter with mode coupler used in the system of FIG. 2.

This polarization filter with mode coupling is shown in FIG. 4 and begins with a square waveguide 12 in which exist the two orthogonally polarized waves of the $H_{10}$ and $H_{01}$ mode. Waveguide 12 is coupled to the polarization converter 2. The square waveguide 12 includes two coupling windows 13 and 14 which are oriented in the E direction transversely to the longitudinal axis of the square waveguide. The width of each coupling window, in the direction of the longitudinal axis of waveguide 12, is equal to about one-half the length, perpendicular to the waveguide longitudinal axis, of a side of the square waveguide cross section. The energy of the $H_{10}$ mode coupled out at the coupling windows 13 and 14 is propagated via respective rectangular waveguides 15, 16.

The two rectangular waveguides 15 and 16 open into a waveguide double T branch which, in correspondence with the reference numerals in the block circuit diagram of FIG. 2, presents the input a for the signal S to be transmitted and a waveguide gate b for energy components of the higher $H_{11}$ and $E_{11}$ modes. The signal coupled out at waveguide b is $\Delta 1$ in FIG. 2.

Each coupling window 13 and 14 is provided with a respective electrically conductive rod 17 or 18 which is inserted into the side walls of the square waveguide 12. These rods are provided as a countermeasure to suppress resonances of higher oscillation forms which generally occur due to the increase in magnitude of the waveguide volume at the location of the coupling windows.

The $H_{01}$ mode signal is conducted through a separating structure 19 in the square waveguide 12 to the output d where the received signal appears. The separating structure 19 includes a sheet metal member mounted between the upper and lower walls of the square waveguide and extending in the direction of propagation from a point near the rear edges of the coupling windows 13 and 14. From that point the sheet metal member tapers toward the center of the guide and toward the front. The edges of the taper define approximately circular arcs ending in a tip 20. The sheet metal member extends vertically in FIG. 4 and is positioned midway between the waveguide vertical side walls.

Thus it is possible to deflect the $H_{10}$ mode coming from the square waveguide 12 into the rectangular waveguides 15 and 16 with the correct impedance and low reflection. The directional attenuation of the coupling arrangement for the $H_{11}$ and $E_{11}$ modes can be influenced by appropriate selection of the length of the tip 20, to attain the highest directional attenuation.

At the end of the separating metal member there is a further waveguide decoupler c, also for the energy components of the higher modes $H_{11}$ and $E_{11}$. The signal coupled out here is identified as $\Delta 2$ in FIG. 2, the block circuit diagram for the entire antenna feeder system. The waveguide outputs c and d, together with the waveguide parts formed by the separating structure 19 constitute a folded double T junction.

Figure 5A:
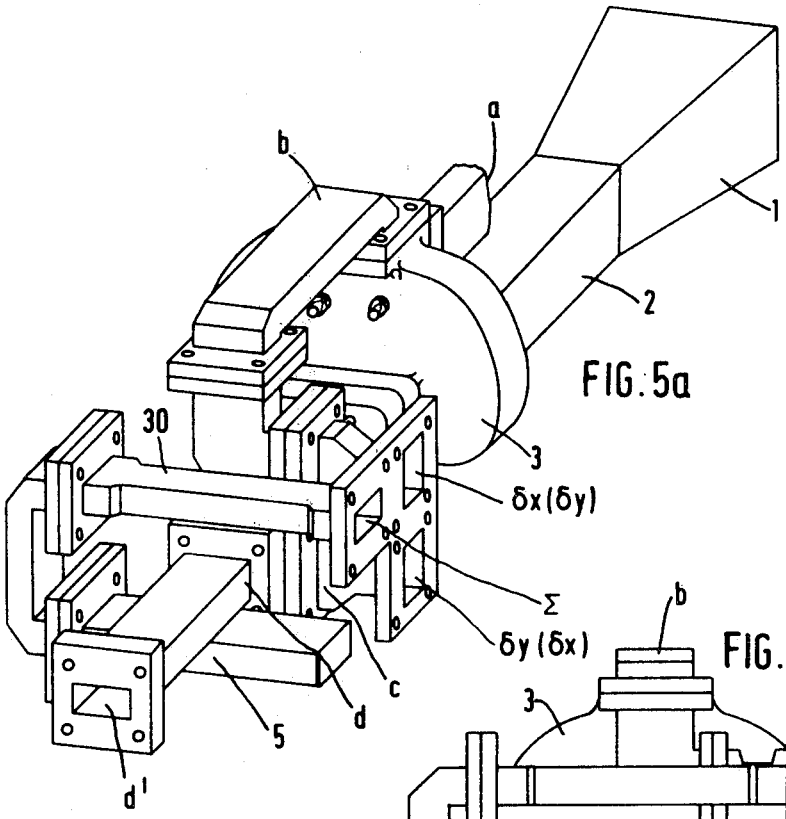
FIGS. 5*a, b* and *c* are, respectively, a perspective view, an end view and a side elevational view of a practical embodiment of an antenna feeder system according to the invention.

Finally, FIGS. 5*a, b* and *c*, illustrate a possible practical structure of the antenna feeder system according to the invention. The individual elements of the antenna feeder system bear the same reference numerals as those in the block circuit diagram of FIG. 2.

The polarization converter 2 with amplitude and phase matching elements is connected to the exciter 1. This is followed by the polarization filter 3 with mode decoupling, including the input a for the signal S to be transmitted, the outputs b and c for the generally still coupled deviation signals $\Delta 1$ and $\Delta 2$ and the output d for the received signal E. Signals $\Delta 1$ and $\Delta 2$ can be separated with the aid of the correction coupler 4 into the uncoupled deviation signals $\delta x$ and $\delta y$.

Figure 5B:
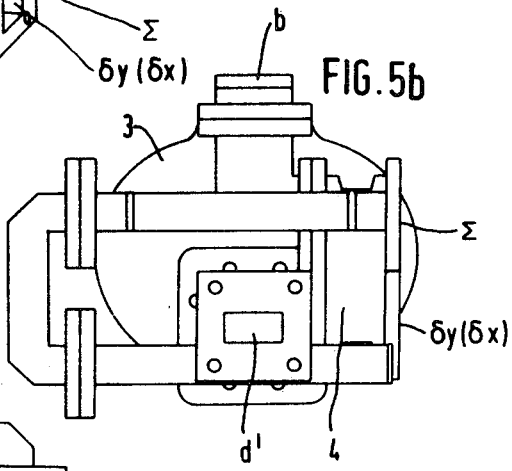
Figure 5C:
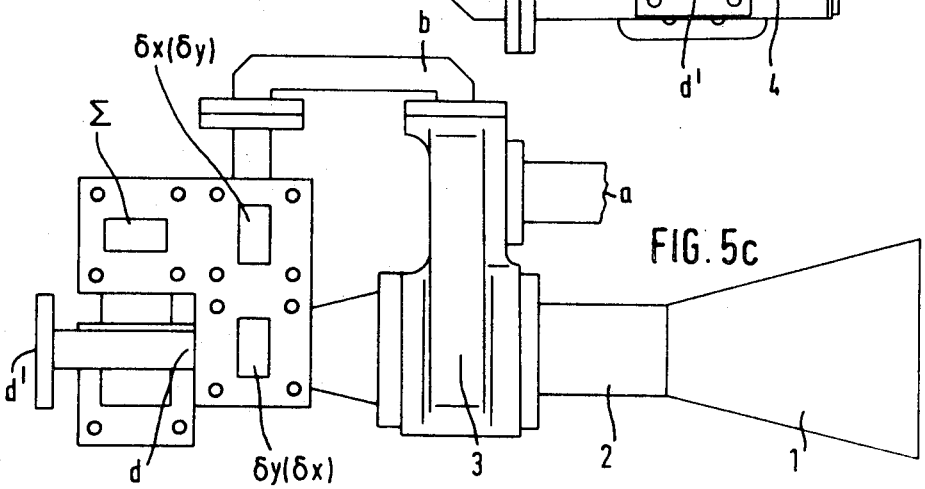

The reference signal $\Sigma$ is split off from the received signal E by means of the frequency filter 5. At the port d' of the frequency filter 5 there appears the interference signal $S_1$ and a possibly additionally transmitted communications signal N which would still have to be separated from the interference signal by means of a further frequency filter (not shown here). The interference signal $S_1$, finally, is fed to an absorber (not shown in FIG. 5).

If the level of the received beacon signal is high enough, as a frequency filter a simple cross directional coupler 5 in connection with a high-pass waveguide 30 can be used. Otherwise it is possible to install any other diplexer design as frequency filter 5.

The correction coupler 4 can perform its function only if its coupling attenuation is matched to the coupling of the deviation signals $\Delta 1$ and $\Delta 2$ and a defined phase relationship of 90° has been set at its input. This phase relationship is set, for example, by selection of the length of the waveguide leading from the waveguide output b to the correction coupler 4.

It must be pointed out that in its central waveguide section the components of the antenna feeder system, such as the polarization converter and polarization filter with mode coupling, may also be formed of circular waveguide sections.

The arrangement of the antenna feeder system according to the invention of course also operates with a circular exciter as the extreme case of the elliptical exciter; in this case amplitude and phase matching in the polarization converter need not be performed.

Further possible modifications reside in the configuration of the inputs and outputs for the communication signals. For example, if additional filter circuits are employed, a received signal can also be obtained from the transmitting input a, or a transmitting signal can be fed into the output N.

It will be understood that the above description of the present invention is susceptible to various modifications, changes and adaptations, and the same are intended to be comprehended within the meaning and range of equivalents of the appended claims.

What is claimed is:

1. In a feeder system associated with an antenna for transmitting circularly polarized signals and for receiving a circularly polarized beacon signal, which system includes an exciter having an aperture whose cross section is symmetrical to at least one major axis of the aperture, the exciter being arranged to excite higher modes of the beacon signal as a function of deviations of the axis of the beacon signal from the major axes of the antenna radiation pattern, and means for coupling the higher modes to produce deviation signals providing information for positioning the antenna in order to eliminate such deviations, the improvement wherein:

said system further comprises a polarization converter containing amplitude and phase compensating components disposed behind said exciter and connected between said exciter and said coupling means for conducting electromagnetic signals therebetween;

said coupling means are included in a polarization filter (ortho-mode-transducer) connected to said converter for receiving and transmitting signals with mutually orthogonal polarization directions; and said polarization filter is provided with a first waveguide branch having a first port for transmitting and for receiving communication signals associated to one polarization direction and an additional port for deviation signals and a second waveguide branch having a second port for transmitting and for receiving communication signals associated to the other orthogonal polarization direction and also an additional port for deviation signals.

2. An arrangement as defined in claim 1 wherein the signal provided by said polarization filter at each said deviation signal output port is a function of the deviation of the beacon signal axis from both major axes of the antenna pattern, and further comprising correction coupler means connected to said deviation signal output ports for deriving two corrected deviation signals each of which is a function of the deviation of the beacon signal axis from one respective major axis of the antenna pattern.

3. Antenna feeder system as defined in claim 2 wherein said correction coupler means comprise a directional coupler.

4. Antenna feeder system as defined in claim 1 wherein said polarization converter comprises a square waveguide constructed to have a coupling attenuation other than 3.01 db to provide amplitude matching, said waveguide being formed to present, at diagonally opposite corners of its cross section, sloping internal walls defining part of said compensating components, and said compensating components further comprise a dielectric plate extending between two diagonally opposite corners of said waveguide cross section and engaging in grooves formed in said waveguide, and a further dielectric plate provided in said waveguide and extending between and perpendicular to, an opposed pair of walls of said waveguide to provide phase matching.

5. Antenna feeder system as defined in claim 1 or 4 wherein, for the purpose of phase matching, said converter is provided with a section having a rectangular cross section at the end thereof near said exciter.

6. Antenna feeder system as defined in claim 1 or 4 wherein said compensating components in said polarization converter are constructed and dimensioned to counteract the frequency dependency of the difference in gain and in phase of the signals propagated therein in both polarization directions as a result of the operating characteristic of said exciter.

7. Antenna feeder system as defined in claim 1 constructed to receive a communications signal together with the beacon signal and further comprising a frequency filter connected to receive the signals appearing at said first communications signal port of said polarization filter and for dividing those signals into a reference signal originating from the beacon signal, the communications signal received from said system and an interference signal constituted by components of a signal applied to said second communications signal port of said polarization filter, said frequency filter including an output at which the interference signal appears and an absorber terminating said output.

8. Antenna feeder system as defined in claim 1 wherein said exciter comprises a feedhorn having a length selected for causing the signal modes excited in said exciter to have a phase position relative to one another such that the deviation signals appearing at said polarization filter additional ports are each a function of the deviation of the beacon signal axis from one respective major axis of the antenna pattern.

9. Antenna feeder system as defined in claim 1, wherein said exciter is a grooved exciter.

* * * * *